US006461080B1

(12) United States Patent
Semeia

(10) Patent No.: US 6,461,080 B1
(45) Date of Patent: Oct. 8, 2002

(54) BALANCING JACKET FOR DIVERS

(75) Inventor: Roberto Semeia, San Salvatore di Cogorno (IT)

(73) Assignee: Scubapro Europe S.r.L. (IT)

( * ) Notice: Subject to any disclaimer, the term of this patent is extended or adjusted under 35 U.S.C. 154(b) by 0 days.

(21) Appl. No.: 09/830,775

(22) PCT Filed: Dec. 27, 1999

(86) PCT No.: PCT/EP99/10392

§ 371 (c)(1),
(2), (4) Date: May 1, 2001

(87) PCT Pub. No.: WO01/02246

PCT Pub. Date: Jan. 11, 2001

(30) Foreign Application Priority Data

Jun. 30, 1999 (IT) ..... GE99A0076

(51) Int. Cl.[7] ..... B63C 9/15; B63C 11/02

(52) U.S. Cl. ..... 405/186; 405/185; 441/96; 441/99; 128/202.14

(58) Field of Search ..... 405/185, 186, 405/187, 192; 441/80, 88, 92, 96, 99, 106, 108, 114; 114/315, 888, 505.7; 2/2.15, DIG. 3; 128/202.14

(56) References Cited

U.S. PATENT DOCUMENTS 3,727,250 A * 4/1973 Koehn et al. ..... 405/186
3,877,098 A * 4/1975 Braly ..... 128/202.14 X
4,137,585 A * 2/1979 Wright, III ..... 114/332 X
4,437,790 A * 3/1984 Trop ..... 405/186
4,529,333 A * 7/1985 Robinette ..... 405/186
4,579,147 A * 4/1986 Davies et al. ..... 137/854
4,720,281 A * 1/1988 Matsuoka ..... 441/92
5,505,559 A * 4/1996 Hermansen ..... 405/186
5,520,485 A * 5/1996 Hermansen ..... 441/96 X
5,620,282 A * 4/1997 Stinton ..... 405/186
5,707,177 A * 1/1998 Lehrer et al. ..... 405/186
6,217,257 B1 * 4/2001 Garofalo et al. ..... 405/186

FOREIGN PATENT DOCUMENTS

EP 318157 * 5/1989 ..... 405/186
WO 8706557 * 11/1987 ..... 405/186

* cited by examiner

*Primary Examiner*—Heather Shackelford
*Assistant Examiner*—Jong-Suk Lee
(74) *Attorney, Agent, or Firm*—Larson & Taylor, PLC

(57) ABSTRACT

An air valve of a balancing jacket can be opened not only by a conventional driving cable located within the corrugated pipe of the balancing jacket, but also independently from the conventional driving cable by an auxiliary driving member integral or operationally connected with the valve element of an air valve and controlled by the diver directly with his hands and/or by a separate control member.

15 Claims, 3 Drawing Sheets

BALANCING JACKET FOR DIVERS

FIELD OF THE INVENTION

The present invention relates to balancing jackets for divers.

BACKGROUND OF THE INVENTION

More specifically, the invention relates to jackets provided with a corrugated pipe, one end of which is connected with the inner inflatable bag of the jacket through a connection body, while the other end is free and provided with means for the air feeding to the jacket, and the jacket communicates with an air valve which is housed in said connection body and whose valve element is kept in the closed position through elastic means and/or the pneumatic pressure within the jacket, while it is connected to a driving cable projecting inside the corrugated pipe and fastened to the free end of the same, the whole so that, extending, at least partially, the corrugated pipe by pulling the free end of the same, the air valve valve element is moved by means of the driving cable to an opened position, to exhaust air out of the jacket. A balancing jacket of this kind is known from U.S. Pat. No. 5,505,559.

SUMMARY OF THE INVENTION

The purpose of the invention is to improve the security of the balancing jackets of the present type, eliminating the danger of an eventual opening impossibility of the air valve by pulling the corrugated pipe, because of a defect, for example an unhooking from the corrugated pipe or the air valve valve element, or a break of the driving cable housed in the corrugated pipe. The invention aims to solve this problem with simple, safe, non-bulky and inexpensive means, reducing at the same time also the cost of a conventional air exhaust device.

The problem is solved by the fact that the air valve valve element itself is connected to auxiliary driving means manually controlled by the diver wearing the jacket independently from the corrugated pipe and from the outer side of the same.

In this way, according to the invention, in case of a break or defect of the driving cable provided within the corrugated pipe and controlled by pulling this pipe, the air valve, normally openable through the corrugated pipe and its inner cable, can be opened through the auxiliary driving means, manually accessible by the diver separately from the corrugated pipe itself. At the same time the invention allows reduction of the security requirements presented till now by the driving cable housed inside the corrugated pipe, and allows one to use less expensive cables than the stainless steel ones with their end eyelets, normally used until now for sake of security. According to the invention, a driving cable housed inside the corrugated pipe can be made of a plastic material, and for example made by two or more threads to reduce the danger of a break, and in particular a plastic molded cable, preferably including two or more parallel threads.

The auxiliary driving means of the air valve valve element with the control outside the corrugated pipe and separated from the same, can be constructively realised in several ways. So, for instance, in a preferred embodiment, the air valve valve element can have a driving extension which is led to the outside by the connection body and is accessible and movable directly or indirectly (for example by means of a control cord on the outside of the jacket) by the diver wearing the jacket, so to move (for example to incline or axially move) the air valve valve element into opened position. According to another embodiment of the invention, the air valve valve element is movable, axially in particular, to the opened position by means of a pushing element, which can be controlled directly by the diver by means of a button control element, or indirectly, for example by means of a control cord out of the jacket and connected to the control button or directly to the pushing element.

BRIEF DESCRIPTION OF THE DRAWINGS

These and other features of the invention and the resulting advantages will be shown in greater detail in the following description of some preferred embodiments, shown as a non-limitative description in the drawings enclosed, wherein.

DETAILED DESCRIPTION OF THE PREFERRED EMBODIMENTS

Figure 1:
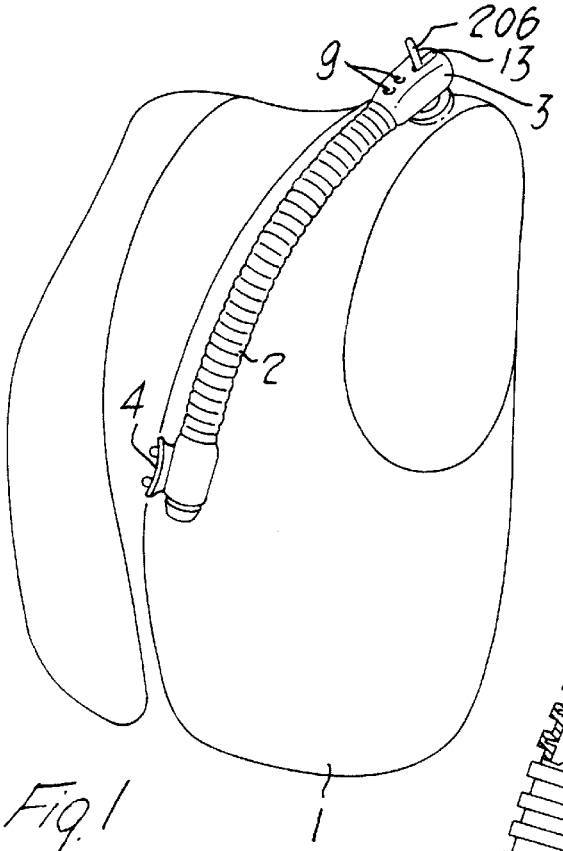
FIG. 1 is a perspective view of a balancing jacket for divers.

In the figures, FIG. 1 shows a balancing jacket for divers. This jacket 1 is inflatable by means of a corrugated pipe 2, whose one end is connected to the jacket 1 inflatable bag through a watertight connection body 2 applied to the jacket 1 and communicating with the said bag. Preferably, the connection body 3 is provided at the highest point of the jacket 1, as shown in FIG. 1, but it can be positioned also at a lower point, for example at the level of the chest. The other end of the corrugated pipe 2 is free and provided with means for the feeding of the air into the jacket 1. To this end, said free end of the corrugated pipe 2 can be provided, for example, with a mouthpiece 4 to inflate the jacket with the mouth.

The jacket 1 is provided with an air valve housed in the connection body 3 and formed by a communication hole 5 between the jacket 1 and the outer space, and a valve element 6 which closes this hole 5. In the embodiment according to FIGS. 1 to 4, the hole 5 is provided in a partition wall 7 within the connection 3 and opens into a chamber 8 communicating with the outside space through one or more openings 9. The valve element 6 is housed in said chamber 8 and is formed like a cap which is axially pushed by a compressed helicoidal spring 10 and this spring makes the valve element 6 watertight against an annular seat provided around the hole 5. The valve element 6 is provided with an inner coaxial shaft 106 and an outer coaxial shaft 206. The inner shaft 106 projects through the hole 5 into the communication compartment between the corrugated pipe 2 and the jacket 1 and is connected with an end of a driving cable 11 which projects inside the corrugated pipe 2 practically to the free end of the same, where it is hooked to the corrugated pipe 2 for instance through an inner transversal pin 12. The outer shaft 206 of the valve element 6 projects instead to outside of the chamber 8 through a slot 13 and thus it projects outside of the connection body 3.

The length of the driving cable 11 is chosen according to the length of the corrugated pipe 2 so that, in standby condition, that is, when no particular pulling strength is put on the corrugated pipe 2, the cable 11 does not put any force on the inner shaft 106 of the valve element 6. The valve element 6 is then kept in the closing position shown in FIG. 2 because of the action of the spring 10. To open the air valve in order to exhaust a certain quantity of air from the inflated jacket 1, the diver wearing the jacket 1 pulls the free end of the corrugated pipe 2 causing an elastic extension of the pipe 2 itself such that it causes—through a pulling on the inner driving cable 11 and the inner shaft 106 of the valve element 6—an inclination of said valve element, and then a partial raising of the same against the action of the spring 10 from its annular seat provided around the hole 5, as shown in FIG. 3. Alternatively, or when the inner driving cable 11 is broken or, for instance, unhooked from the free end of the corrugated pipe 2 and/or the inner shaft 106, the air valve can be opened by the diver wearing the jacket 1 through a manual control independent from the corrugated pipe 2 and outside the same. For this purpose, in the embodiment according to the FIGS. 1 to 3, the diver directly operates with his hand the valve element 6 outer shaft 206, putting on said shaft 206 a transversal strength in the direction of the arrow F of FIG. 3, to incline said outer shaft 206 and with it the valve element 6, thus moving the valve element 106 into the partial opening position according to FIG. 3. In both cases, when the air valve valve element 6 is opened with inclination, the outer shaft 206 moves within the slot 13.

Figure 2:
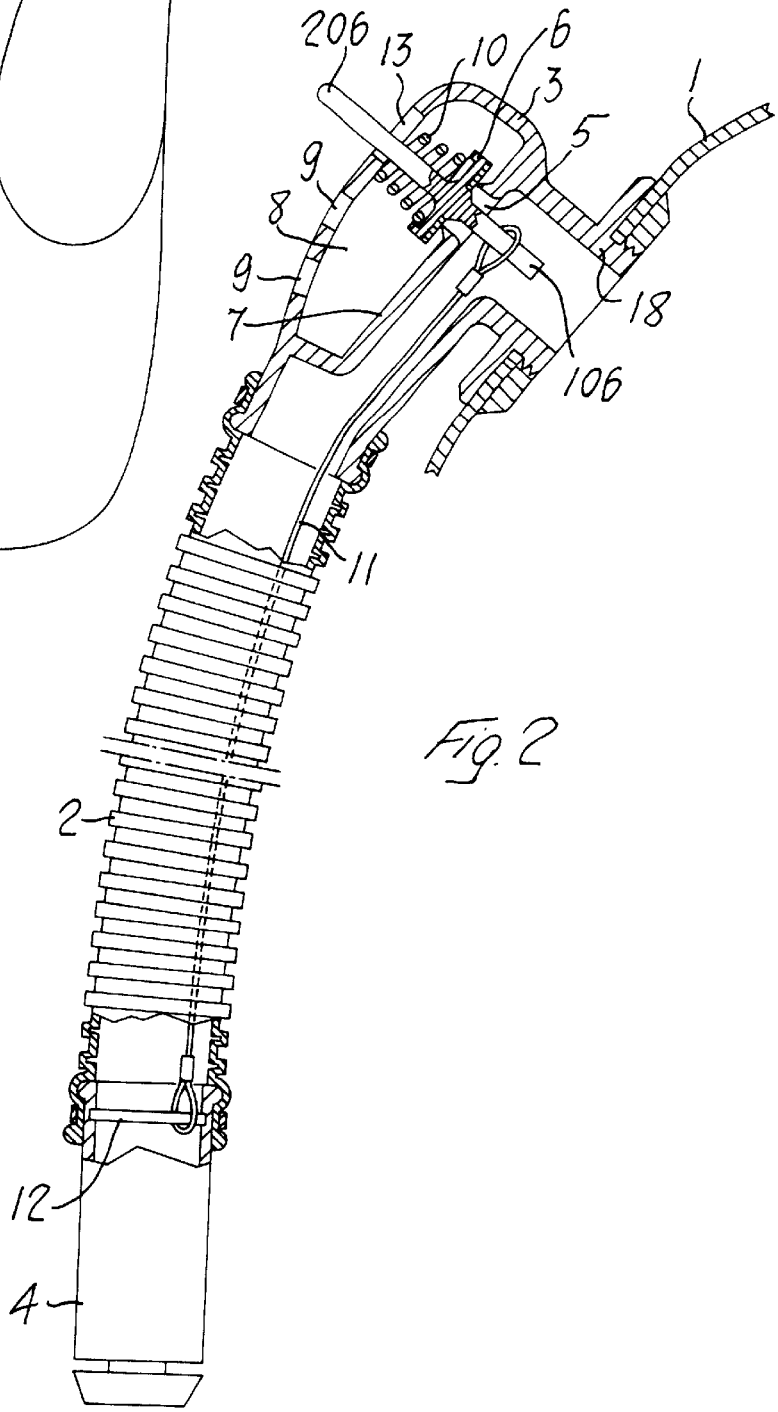
FIG. 2 is a longitudinal view partially in section of the corrugated pipe for the feeding of the air in the jacket, showing its connection to the jacket and showing the air valve in a closed position.
Figure 4:
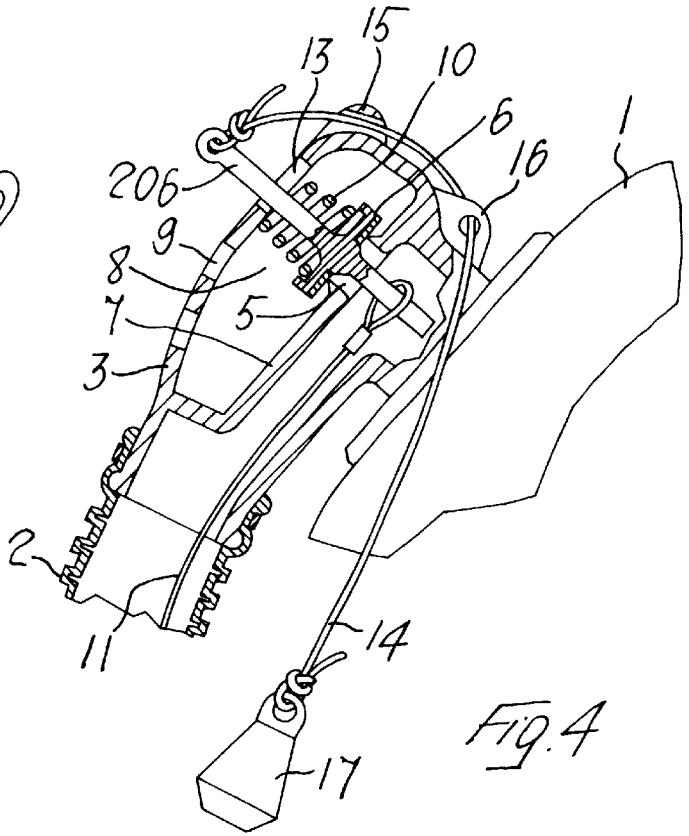
FIG. 4 is a section view of another embodiment of the control means of the air valve.
Figure 3:
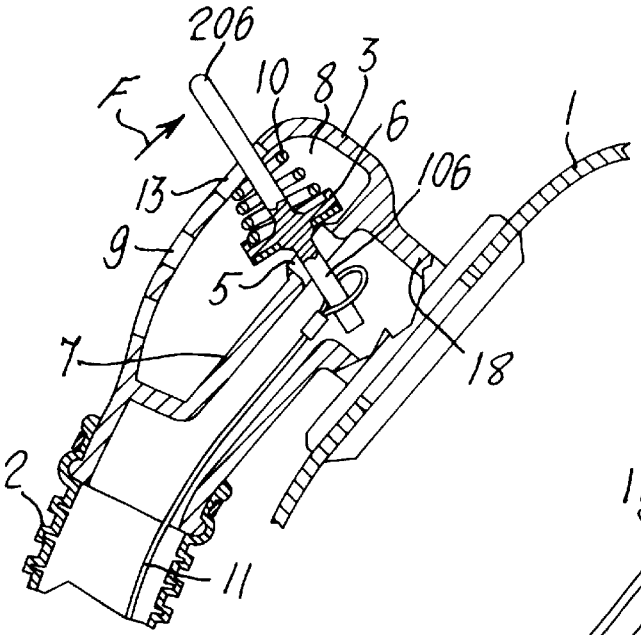
FIG. 3 is a section view of the air valve of FIG. 2 in an opened position.

The embodiment shown in FIG. 4 differs from the one according to FIGS. 1 to 3 just in the fact that the outer shaft 206 of the air valve valve element 6 can be moved to the opening inclined position not only through a direct manual control of the diver, but also through and indirect manual control. For this purpose, the valve element 6 outer shaft 206 is connected through a control cord 14 advantageously returned through outer guide eye-lets 15, 16 of the connection body 3, to hang freely downward on the outer front side of the jacket 1, being provided at its free end with a catching knob 17. To open the air valve, i.e., to incline the valve element 6 of said valve to its opening position, independently from the corrugated pipe 2, the diver wearing the jacket 1 catches the knob 17 and pulls the control cord 14 without being obliged to raise his hand to the connection 3, as necessary in the embodiment according to FIGS. 1 to 3.

In the embodiment forms according to FIGS. 1 to 4, the axis of the hole 5 and the valve element 6 with the shafts 106, 206 is substantially set transversally to the corrugated pipe 2 and perpendicularly as to the jacket surface 1, and coaxially as to the pipe union 18 connecting the upper end of pipe 2 with the inflatable bag of the jacket 1 itself. In the embodiments according to FIGS. 6 to 8 instead—where the parts equivalent to those already described are indicated with the same reference numbers—the axis of the hole 5 and the valve element 6 is substantially set in the longitudinal direction of the corrugated pipe 2 and parallel to the jacket 1 surface, i.e., transversally as to the pipe union 18 connecting the upper end of pipe 2 with the inflatable bag of the jacket 1. Moreover, in these embodiments according to FIGS. 6 to 8, the valve element 6 is not housed in the body 3 chamber 8, but it is on the inner side, opposite to the chamber 8, of its partition wall 7 and cooperates with an annular seat provided around the hole 5 on the inner side of the partition wall 7. The valve element 6 is provided with a coaxial shaft 306 passing through the hole 5 and projecting into the chamber 8, where there is provided an enlarged guide head 19 sliding in the chamber 8 itself. Between this guide head 19 and the partition wall 7 there is inserted a helicoidal preloaded compression spring 20 which makes the valve element 6 watertight axially adhere against the associated valve annular seat around the hole 5 on the inner side of the partition wall 7. The chamber 8 has one or more openings 9 communicating with the outside space.

For the opening of the air valve, the valve element 6 is connected with a driving cable 11 extending along the corrugated pipe 2 and connected at its free end, for example in the way described with reference to FIG. 2. When pulling the free end of the corrugated pipe 2 in order to extend this pipe so that it pulls the driving cable, the valve element 6 is axially raised from its seat against the force of the spring 20 and moved axially to an opened position (instead of being inclined as in the embodiments according to FIGS. 1 to 4).

Figure 6:
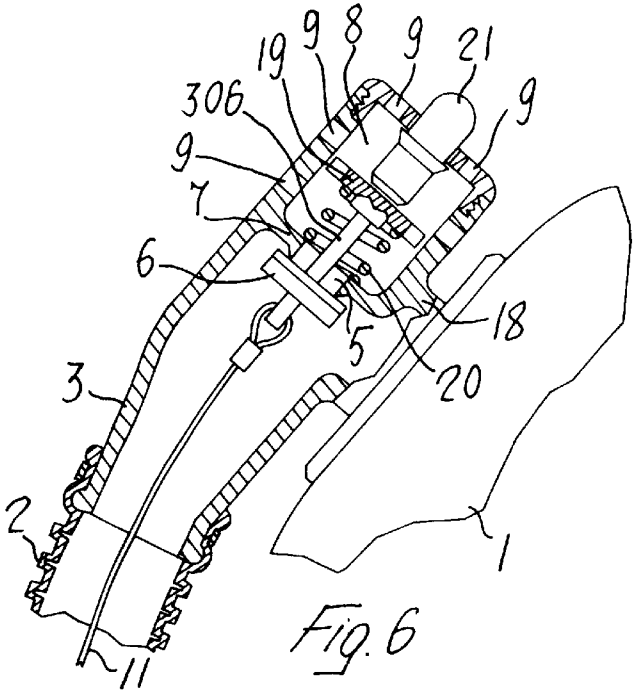

The auxiliary opening means of the air valve with control outside the corrugated pipe 2 and independent from the same are formed, in the embodiment form of FIG. 6, by a button pin 21 axially standing against the head 19 of the shaft 306 of the valve element 6 in the chamber 8 and projects out of this chamber 8 in a sliding way through a corresponding hole provided in its head wall. To open the air valve it is sufficient to axially push button pin 21 from the outside, which pushes and raises the valve element 6 by means of the shaft 306 and against the force of the spring 20, axially toward the inside of its valve seat around the hole 5. The button pin 21 is provided with a side stop prominence which abuts against the head wall inner side of the chamber 8 and prevents the expulsion of the button pin 21 by the spring 20.

Figure 7:
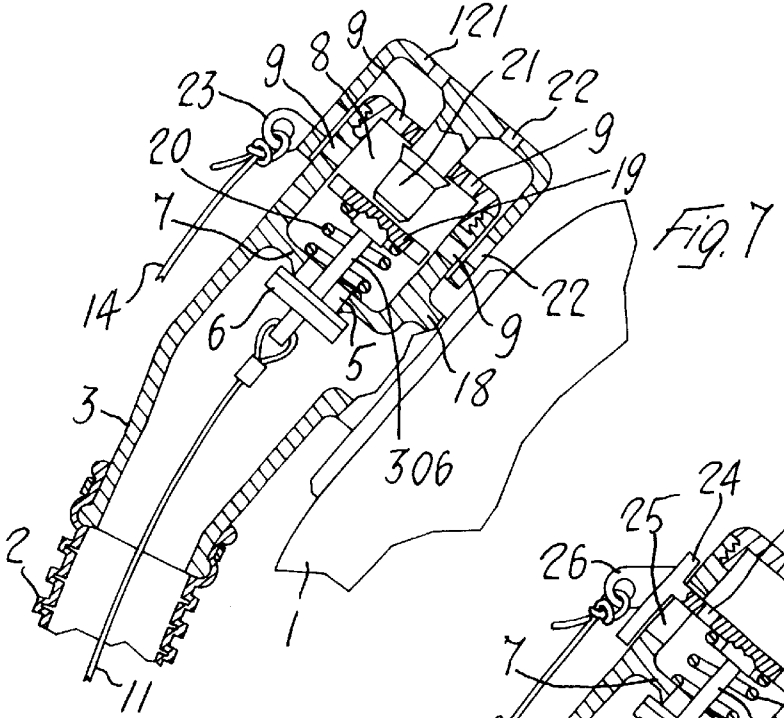
FIGS. 6, 7 and 8 are section views of three other embodiments of the control means of the air valve.

The embodiment according to FIG. 7 differs from the one according to FIG. 6 in that the button pin 21 has a driving outer extension shaped as a cap 121 slidingly enclosing its head end in the connection body 3. The cap outer extension 121 is provided both with head and side openings 22 which ensure a free entering of the water into the chamber 8 through its openings 9. Moreover, the cap button 21, 121 of the embodiment according to FIG. 7 is connected through a side eyelet 23 with a control cord 14, similar to the one described with reference to FIG. 4. In this way, the air valve valve element 6 can be axially moved into opening position both directly by putting a manual pressure on the cap button 21, 121 and indirectly by pulling the cord 14.

Figure 8:
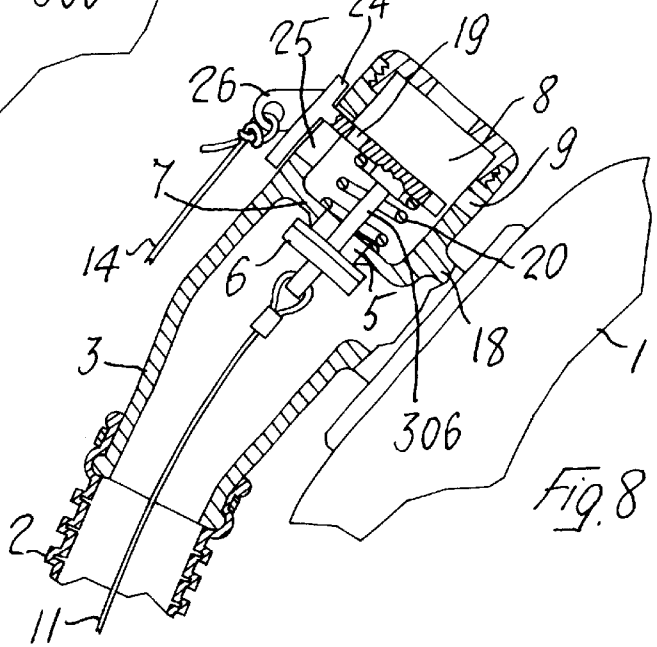

The embodiment form according to FIG. 8 differs from those according to FIGS. 6 and 7 in that the button pin 21 and the cap button 121 are absent and the head 19 of the valve element shaft 306 has a side extension 24 which projects out of the chamber 8 through a side slot 25 parallel to the valve element 6 axis and its shaft 306. The valve element 6 can be axially moved to its opened position by operating on the outer extension 24 of the head 19 of its shaft 306, directly with the hand (for example on a knob or a lever integral with said extension 24) and/or indirectly by means of a pulling control cord 14, fastened to an eyelet 26 provided on said extension 24.

The driving cable 11 housed inside the corrugated pipe can be made in a conventional way and can be for instance a stainless steel cable with eyelet shaped ends, as shown in FIG. 2.

Figure 5:
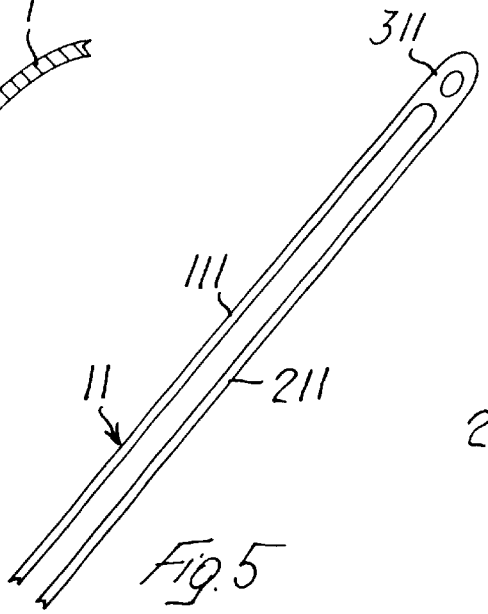
FIG. 5 shows the upper end part of the driving cable of the air valve, housed in the corrugated pipe.

In all the embodiments shown and described above, the possibility to operate the valve element 6 and to open the air valve as required by means of auxiliary control means 206, 21, 121, 14 independent from the cable 11 housed in the corrugated pipe 2 and outside said pipe, allows reducing the requirements concerning the resistance and security of the cable 11 and allows use of a less expensive driving cable 11. All the embodiments according to the invention can use a driving cable 11 of the type shown in FIG. 5 and formed by a molded plastic material, preferably including two or more threads 111, 211 parallel to each other and connected to the ends through an eyelet end 311.

Naturally, the invention is not limited to the embodiments described above and shown, but can be widely changed and modified, especially in a constructive way and for what relates to the mechanical and functional equivalents, and also applied to any kind of balancing jacket for divers, without departing from the spirit and scope of the invention.

What is claimed is:

1. A balancing jacket for divers, comprising a corrugated pipe, one end of which corrugated pipe is connected to an inner inflatable bag of the jacket through a connection body, while the other end of the corrugated pipe is a free end which is provided with means for feeding air to the jacket, said jacket communicating with an air valve which is housed in the connection body and which has a valve element which is normally biased to a closed position, the valve element being connected to a driving cable projecting inside of the corrugated pipe and fastened to the free end of the driving cable, such that by pulling the free end of the corrugated pipe, the valve element of the air valve is moved by means of the driving cable to an opened position to exhaust air out of the jacket, the valve element being connected to an auxiliary driving means which is manually controllable by the diver wearing the jacket independently from the corrugated pipe and controllable from outside of the corrugated pipe.

2. A balancing jacket according to claim 1, wherein the valve element is operationally connected to the auxiliary driving means which project out of the connection body and can be moved by the diver wearing the jacket, directly, manually or indirectly by means of interposed control means to move the valve element to the opened position.

3. A balancing jacket according to claim 1, wherein the auxiliary driving means is operationally connected to the valve element and projects out of the connection body on the side of the air valve opposite from its communication with the jacket.

4. A balancing jacket according to claim 1, wherein the valve element is tiltable to the opened position, and the auxiliary driving means comprises an extension of the valve element, positioned in such a way that the extension can be angularly moved from outside of the connection body.

5. A balancing jacket according to claim 4, wherein the auxiliary driving means comprises a control shaft which is coaxial with the valve element and which projects outside of the connection body through a slot formed in the side of the connection body.

6. A balancing jacket according to claim 1, wherein the valve element is axially movable to an opened position and the auxiliary driving means comprises a control element slidable parallel to the shifting axis of the valve element.

7. A balancing jacket according to claim 6, wherein the control element is a button pin which is substantially coaxial with the valve element axis and which projects outside of the connection body through a hole formed in the side of the connection body.

8. A balancing jacket according to claim 7, wherein the button pin is integral with the valve element.

9. A balancing jacket according to claim 8, wherein the button pin has a cap-shaped outer extension.

10. A balancing jacket according to claim 7, wherein the button pin is separated from the valve element and operates on the valve element through a shaft and a sliding guide head of the valve element.

11. A balancing jacket according to claim 6, wherein the control element is a side extension of the valve element, said side extension slidingly projecting out of the connection body through a slot formed in the side of the connection body and movable parallel to the movement of the valve element.

12. A balancing jacket according to claim 1, wherein the auxiliary driving means are connected through a control cord which hangs on the jacket chest so that the diver wearing the jacket can easily grasp it.

13. A balancing jacket according to claim 1, wherein the driving cable inside the corrugated pipe is made of a plastic material.

14. A balancing jacket according to claim 13, wherein the driving cable is made of a molded plastic material.

15. A balancing jacket according to claim 14, wherein the driving cable is formed with at least two separate threads.

* * * * *